United States Patent [19]

Frye

[11] 4,040,214

[45] Aug. 9, 1977

[54] ADJUSTABLE GROUND SUPPORT FOR VOLLEYBALL POLES AND THE LIKE

[76] Inventor: Norman V. Frye, R.R. 4, Davenport, Iowa 52804

[21] Appl. No.: 736,779

[22] Filed: Oct. 29, 1976

[51] Int. Cl.[2] ..... E02D 5/74; A45F 3/44

[52] U.S. Cl. ..... 52/157; 248/156

[58] Field of Search ..... 52/155, 157, 296, 298; 248/156, 158

[56] References Cited

U.S. PATENT DOCUMENTS

| | | | |
|---|---|---|---|
| 3,076,532 | 2/1963 | Frye | 52/157 |
| 3,197,928 | 8/1965 | Frye | 52/157 |
| 3,328,928 | 7/1967 | Frye | 52/157 |
| 3,636,670 | 1/1972 | Frye | 52/157 |
| 3,996,707 | 12/1976 | Frye | 52/157 |
| 3,996,708 | 12/1976 | Frye | 52/157 |

*Primary Examiner*—James L. Ridgill, Jr.

[57] ABSTRACT

The support is of inverted L shape and its depending leg is vertically adjustable to select the extent to which the leg will penetrate the ground. The other leg then overlies the ground and has pole-supporting means at its free end.

10 Claims, 9 Drawing Figures

ADJUSTABLE GROUND SUPPORT FOR VOLLEYBALL POLES AND THE LIKE

BACKGROUND OF THE INVENTION

The present applicant's four prior U.S. Pat. Nos. 3,076,532; 3,328,928; 3,197,928 and 3,636,670 and his two pending U.S. patent applications Ser. Nos. 689,059 and 689,060, filed May 24, 1976, now U.S. Pat. Nos. 3,996,707 issued Dec. 14, 1976 and 3,996,708 issued Dec. 14, 1976, respectively, best illustrate the prior art in the field to which the present invention relates. Broadly, these prior patents and patent applications have in common one form or another of inverted L-shaped structure in which a depending leg penetrates the ground and a lateral leg overlies the ground to carry a volleyball pole at its free end. The continuing design behind these inventions and improvements aims at developing structures that feature strength and ruggedness to stand up under the rigors of outdoor volleyball as played by sportsmen and women who participate vigorously, structures that are simple and relatively inexpensive, that are easily packaged and that may be conveniently manufactured.

The most recently popular of these designs are the two disclosed in the aforementioned pending applications, wherein the depending leg in each case is a helix which may be screwed into the ground, using the lateral leg and pole-receiving means as a crank. More recent experience has revealed that unless the helix is made extremely long, the support loses its connection to loose soil, sand, gravel, etc., primarily sand on beaches where volleyball has become popular, especially where a portable kit is available, such as applicant provides, complete with ground anchors, poles and net.

SUMMARY OF THE INVENTION

The present invention solves the problem of anchoring the support in sand and the like by providing vertical adjustability of the ground-penetrating leg. This is by far preferable to attempting a solution via an extra-long helix, because it is less expensive and retains the packageability of the unit. Specifically, the support is made up of an inverted L-shaped, one-piece member of square cross-section, the lateral or ground-overlying leg receiving the pole-supporting means and the depending leg being extendible and retractable by means of being telescopically received by an extension member of square, tubular cross-section having at its lower end a "spade" in the form of a plate twisted to provide a section of an auger for screwing into the sand, for example. Simple means is provided for securing the tubular member and depending leg in any one of several adjusted positions. The present invention is particularly an improvement over applicant's abovementioned patent 3,076,532 (FIG. 5), because it is more versatile, solves new problems and yields more advantages cost-wise. Other features willbecome apparent as the disclosure proceeds.

DESCRIPTION OF A PREFERRED EMBODIMENT

Figure 1:
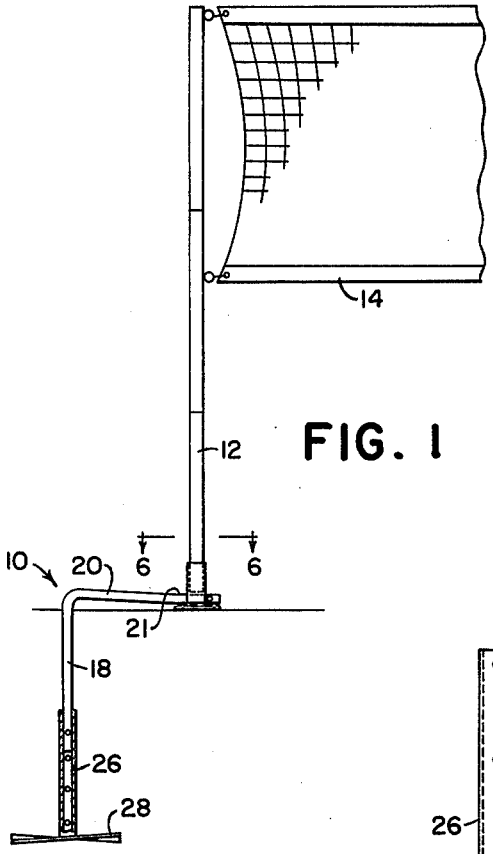
FIG. 1 is an "environmental" view, showing the support in use with one of two volleyball poles and a portion of a net.

Reference will be had initially to FIG. 1. The total ground support or anchor is shown at 10 as supporting an upright volleyball pole 12, it being understood that the arrangement is duplicated (not shown) in spaced relation to the anchor 10 and pole 12 so that a net 14 is tensioned between the two poles. The foregoing may be regarded as conventional to the extent shown in the above-identified prior disclosures of applicant.

Figure 2:
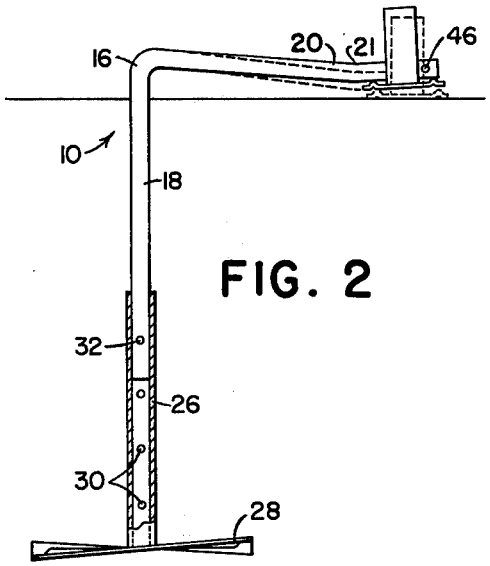
FIG. 2 is an enlarged partial vertical section of the support, showing in dotted lines flexing of the lateral leg downwardly as the net is tightened.
Figure 3:
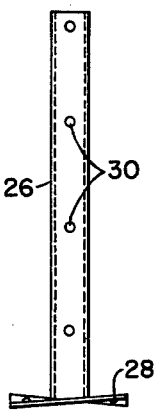
FIG. 3 is an enlarged elevation of the tubular element of the groundpenetrating part of the anchor or support.
Figure 4:
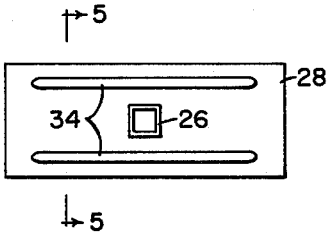
FIG. 4 is a plan of the element shown in FIG. 3.
Figure 5:
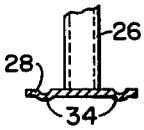
FIG. 5 is a section on the line 5—5 of FIG. 4.

The basic unit of the anchor 10 is a one-piece, steel, inverted L-shaped member 16 (FIG. 8) of uniform non-circular section, here square (FIG. 9), having a depending leg 18 and a lateral leg 20. The extremities of the legs have cross openings or bores 22 and 24 respectively, for purposes to presently appear. The depending leg 18 is extendible by means of being vertically telescopically received in a tubular element 26 (FIG. 3) of non-circular section, here square to match that of the leg 18. The lower end of the element 26 carries rigidly thereon a plate or "spade" in the form of a rectangular plate 28 formed with a twist (FIGS. 1, 2 and 3) to afford a section of an auger or screw. When the leg 18 of the L-shaped member 16 is received by the tubular element 26, the two are of course relatively non-rotatable and, using the leg 20 as a crank arm, the spade may be screwed into the ground. The tubular element has a plurality of cross bores 30, any one of which may be selected to match up with the bore 22 in the leg 18, and a suitable pin, cotter, etc. 32 (FIG. 2) may be used as a securing to retain the selected adjusted position of the leg 18 and tubular element 26. FIG. 2 shows the shortest adjusted position. The longest position would of course be obtained by securing the parts together at the topmost hole or bore 30. The selected adjusted position depends upon the user's determination as to whether the "connection" to the ground, sand, etc. is adequate. In some cases, as where only the poles and net are to be removed and replaced at the same site later, the user may decide to omit the pin 32, leaving the tubular elements in the ground and inserting the leg member 16 again. Obviously, it would be necessary to mark the locations of the buried elements.

Rigidity is afforded to the screw or spade by the provision of reenforcing ribs 34, preferably by pressing channels into the plate so that the ribs are integral parts of the plate.

Figure 6:
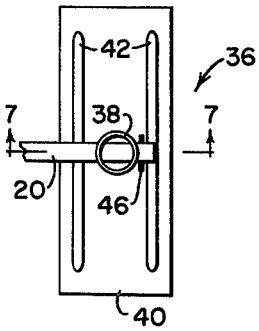
FIG. 6 is an enlarged fragmentary view as seen on the line 6—6 of FIG. 1, with the volleyball pole omitted.
Figure 7:
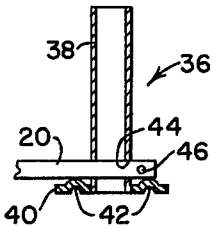
FIG. 7 is a section on the line 7—7 of FIG. 6.

The free or terminal end of the lateral leg 20 carries pole-receiving means 36 (best seen in FIGS. 6 and 7). This means is shown here as comprising an upright socket 38 welded to a base 40. The socket is preferably circular in section to receive the lower end of the associated pole 12. As a matter of convenience in packaging and portability, each pole is provided as three end-to-end interfitting sections, as has been done by applicant in the past. The base 40 is preferably rectangular and of substantial area so as to provide a foot-hold on the ground and is reenforced by ribs or channels 42 (FIGS. 6 and 7), these being press-formed and thus integral with the base. The disposition of the base relative to the net 14 is such that the length of the base is normal to the plane of the net ground-wise (FIG. 6).

The pole-receiving means is carried by the leg 20 by means of a pair of alined, non-circular openings 44 (FIG. 7), these being in the present case square and matching the leg so as to be received by the leg. A pin, cotter, etc. may be used as means 46 to prevent the pole-receiving means from separating from the leg 20.

When the unit is packaged, the tubular member 26 and pole-receiving means 36 are removed from the leg member 16 and the pins 32 and 46 may be separately packaged or may be of the "snap" type and temporarily stored in the respective openings. When the structure is assembled for use, it comprises an inverted L-shaped structure in which the depending element is a two-part means comprising the leg 18 and the tubular element 26 with its spade 28, the ground-overlying part being the leg 20 of the leg member 16. Because of the matching non-circular sections, the leg 18 cannot turn relative to the tubular element 26 and the pole-receiving means cannot turn relative to the leg 20. This alone eliminates the need for costly set screws and the like, it being understood that the pin 46 is provided to prevent inadvertent separation of the pole-receiving means from the leg 20.

Figure 8:
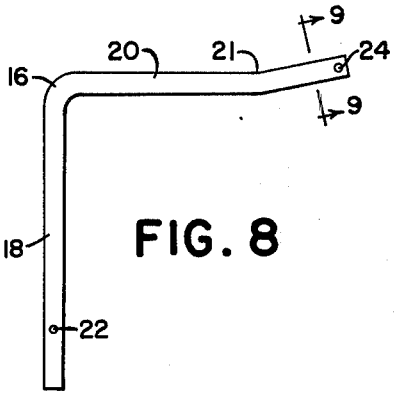
FIG. 8 is an elevation of the one-piece L-shaped member.
Figure 9:
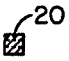
FIG. 9 is a section on the line 9—9 of FIG. 8.

As best seen in FIG. 8, the lateral leg 20 is of novel construction, in that its terminal or free end portion is bent slightly upwardly or away from the ground when considered as in FIG. 2, full lines. Preferably a bend at 21 occurs at a distance in the order of from one-quarter to one-third of the total length of the leg, and the angle so formed is in the order of 5° or slightly less to about 10° from the horizontal, thus giving the leg a first, long portion extending from the junction with the depending leg 18 to the bend 21 and a second shorter portion extending from the bend 21 to the free end of the leg.

This shape of the leg 20 affords many advantages, both in use and in assembling of the structure. Considering the assembly of the L-shaped member to the ground-penetrating member 26, it will be seen that the bend 21 makes it impossible to inadvertently insert the leg 20 fully into the tube 26. This is important because of the difference in the locations of the holes 22 and 24, the former being farther inwardly from the end of the leg 18 than the latter is from the end of the leg 20. The hole 24 is located so that the pole-receiving means 36 may be properly located at the extreme end of the leg 20, while the hole 22 is located to match selectively with the holes 30 in the tube 26. As will be seen, the hole 22 would be too far inwardly to properly locate the pole-receiving means and the hole 24 is too close to the end of the leg to take the screw-in torque involved in screwing the tube into the sand. The bend 21 thus operates as a "no go" stop means and it is unnecessary to detail the assembly in the instructions accompanying the packaged set.

Also, the bend 21 serves as a stop means to limit the inward assembly of the pole-receiving means, and thus that means is confined between the bend and the pin 46. A further function of the bend is to cause the pole-receiving means to tilt upwardly and outwardly (FIG. 2, full lines) at an initial stage in installation, and the pole 12 will also tilt the same way. But when the net is drawn taut between the two tilted poles, the flex in the L-shaped member — occuring mainly at the junction of the legs 18 and 20 — provides enough "give" in the supports 10 to enable the poles to achieve erect playing positions. Compare the dotted and full-line positions in FIG. 2.

I claim:

1. A support for poles and the like of the type including an inverted L-shaped structure having a depending part adapted to penetrate the ground and a lateral part adapted to overlie the ground and an upwardly directed pole-receiving means carried by the lateral part in spaced relation to the depending part, characterized in that a one-piece inverted L-shaped member of uniform non-circular section has a lateral leg constituting the aforesaid lateral part and a depending leg constituting one of two elements of the depending part, the other element of the depending part being a vertical tubular element of uniform non-circular section matching that of the depending leg and vertically telescopically and adjustably receiving said leg, means is provided for securing the tubular element and depending leg in any of several selected positions of vertical adjustment whereby to vary the extent to which the depending part penetrates the ground, and the pole-receiving means has a lateral opening therein of non-circular section and receiving the aforesaid lateral part.

2. The support of claim 1, further characterized in that the lateral leg includes stop means thereon spaced inwardly from its free end at a distance permitting assembly of the pole-receiving means but preventing full insertion of said leg into the tubular element during initial assembly of the support.

3. The support as defined in claim 1, further characterized in that the cross-section of the tubular element and the depending leg is square and the opening in the pole-receiving means is similarly square.

4. The support as defined in claim 1, further characterized in that the pole-receiving means has a base for engagement with the ground and said base is of substantial area and is provided with reenforcing ribs.

5. The support as defined in claim 1, further characterized in that the lower end of the tubular element carries rigidly thereon a plate in the form of the section of an auger so as to enable the structure to be screwed into the ground.

6. The support of claim 5, further characterized in that the plate is rectangular and is provided with reenforcing ribs.

7. The support of claim 1, further characterized in that the lateral leg includes stop means spaced inwardly from its free end at a distance greater than the cross-sectional dimension of the pole-receiving means for limiting inward assembly of the pole-receiving means on said leg.

8. The support of claim 7, further characterized in that the stop means comprises a bend in the leg.

9. The support of claim 1, further characterized in that the lateral leg has a bend therein to provide the leg with a first, long portion extending between the bend and the junction of said leg with the depending leg and a second, short portion extending between the bend and the terminal end of said lateral leg.

10. The support of claim 9, further characterized in that the short portion is of a length on the order of from one-quarter to one-third of the total length of said leg and the bend provides between the leg portions an angle in the order of 170° to 175°.

* * * * *